US009660331B2

(12) United States Patent
Babbitt et al.

(10) Patent No.: US 9,660,331 B2
(45) Date of Patent: May 23, 2017

(54) RADIO MODEM ANTENNA EFFICIENCY IN ON BOARD DIAGNOSTIC DEVICE

(71) Applicant: Novatel Wireless, Inc., San Diego, CA (US)

(72) Inventors: William Babbitt, San Diego, CA (US); Kevin Clancy, Calgary (CA); Pedro Gutierrez, San Diego, CA (US)

(73) Assignee: Novatel Wireless, Inc., San Diego, CA (US)

( * ) Notice: Subject to any disclaimer, the term of this patent is extended or adjusted under 35 U.S.C. 154(b) by 240 days.

(21) Appl. No.: 14/242,697

(22) Filed: Apr. 1, 2014

(65) Prior Publication Data

US 2015/0070220 A1 Mar. 12, 2015

Related U.S. Application Data

(60) Provisional application No. 61/807,165, filed on Apr. 1, 2013.

(51) Int. Cl.

| | |
|---|---|
| ***H01Q 1/24*** | (2006.01) |
| ***H01Q 1/48*** | (2006.01) |
| ***H01Q 1/32*** | (2006.01) |
| ***H01Q 23/00*** | (2006.01) |

(52) U.S. Cl.
CPC ..... *H01Q 1/48* (2013.01); *H01Q 1/3233* (2013.01); *H01Q 23/00* (2013.01)

(58) Field of Classification Search
CPC ..... H01Q 1/48; H01Q 1/3233; H01Q 1/243
USPC ..... 343/702, 846, 848
See application file for complete search history.

(56) References Cited

U.S. PATENT DOCUMENTS

| | | | | |
|---|---|---|---|---|
| 6,342,859 | B1 * | 1/2002 | Kurz | H01Q 1/242 343/700 MS |
| 7,012,571 | B1 * | 3/2006 | Ozkar | H01Q 1/243 343/702 |
| 7,620,436 | B2 * | 11/2009 | Krenz | H01Q 1/242 343/848 |
| 2007/0120748 | A1 * | 5/2007 | Jenwatanavet | H01Q 1/243 343/702 |
| 2012/0230377 | A1 * | 9/2012 | Jenwatanavet | H01Q 1/085 375/222 |

* cited by examiner

*Primary Examiner* — Hoanganh Le
(74) *Attorney, Agent, or Firm* — TechLaw LLP

(57) ABSTRACT

An on board diagnostic (OBD) device having a radio modem is provided. An antenna of the radio modem is connected to a printed circuit board (PCB) housed within a plastic housing, where the PCB has a ground plane which is extended by a conductive extension. The conductive extension lengthens an effective length of a counterpoise of the antenna without necessitating an increase in size of the OBD device/plastic housing, resulting in maintaining a small form factor for the OBD device, while increasing antenna efficiency and/or bandwidth.

20 Claims, 4 Drawing Sheets

RADIO MODEM ANTENNA EFFICIENCY IN ON BOARD DIAGNOSTIC DEVICE

This application claims the benefit of U.S. Provisional Application No. 61/807,165, filed Apr. 1, 2013, which is hereby expressly incorporated by reference in its entirety for all purposes.

TECHNICAL FIELD

The present application relates generally to portable communications devices, and more particularly, to a conductive element for a radio modem antenna inserted into or attached to a connector of an on board diagnostic device.

BACKGROUND

On board diagnostics (OBD) can refer to a vehicle's self-diagnostic and reporting capability. OBD systems can give an owner of the vehicle, or a repair technician, access to certain data/information relevant to operation of the vehicle, e.g., state of health information. While early instances of OBD involved the illumination of, e.g., a malfunction indicator light, more recent instances of OBD can use digital communications to provide data, such as real-time data, in addition to a standardized series of diagnostic trouble codes, for identifying and remedying malfunctions within a vehicle.

An OBD device can refer to an electronic apparatus that connects with an OBD port of, e.g., a vehicle, and reads data from the vehicle.

SUMMARY

Various embodiments are set out in the claims.

According to a first embodiment, an apparatus comprises a printed circuit board having a ground plane. The apparatus further comprises a printed circuit board having a ground plane, and a wireless transceiver comprising an antenna element operatively connected to the printed circuit board such that the ground plane defines a counterpoise for the antenna element, the counterpoise having an effective length. Further still, the apparatus comprises an extension element, coupled to the ground plane in at least one of an electrical or mechanical manner, for extending the effective length of the counterpoise.

According to a second embodiment, an OBD device comprises an integrated radio modem communicatively coupled with a printed circuit board, the printed circuit board comprising a ground plane. The OBD device further comprises an antenna mounted to the printed circuit board, wherein the ground plane defines a counterpoise for the antenna, the counterpoise having an effective length. Further still, the OBD device comprises a connector, the connector comprising a conductive extension, the conductive extension being conductively coupled to the ground plane to extend the effective length of the counterpoise in a direction away from the antenna.

According to a third embodiment, an OBD device comprises a printed circuit board having a ground plane, the printed circuit board being located within a housing, and the housing comprising an integrated connector. The OBD device further includes a radio modem and an antenna operatively connected to the radio modem, the antenna being mounted to the printed circuit board such that the ground plane provides a counterpoise for the antenna, the counterpoise having an effective length. Additionally, the integrated connector comprises a conductive element connected to the ground plane in at least one of a mechanical or electrical fashion, the conductive element being configured to extend the effective length of the counterpoise away from the antenna, such that the extended effective length of the counterpoise is greater than a length of the ground plane.

BRIEF DESCRIPTION OF THE DRAWINGS

For a more complete understanding of example embodiments, reference is now made to the following descriptions taken in connection with the accompanying drawings in which.

DETAILED DESCRIPTION OF THE DRAWINGS

Figure 1:
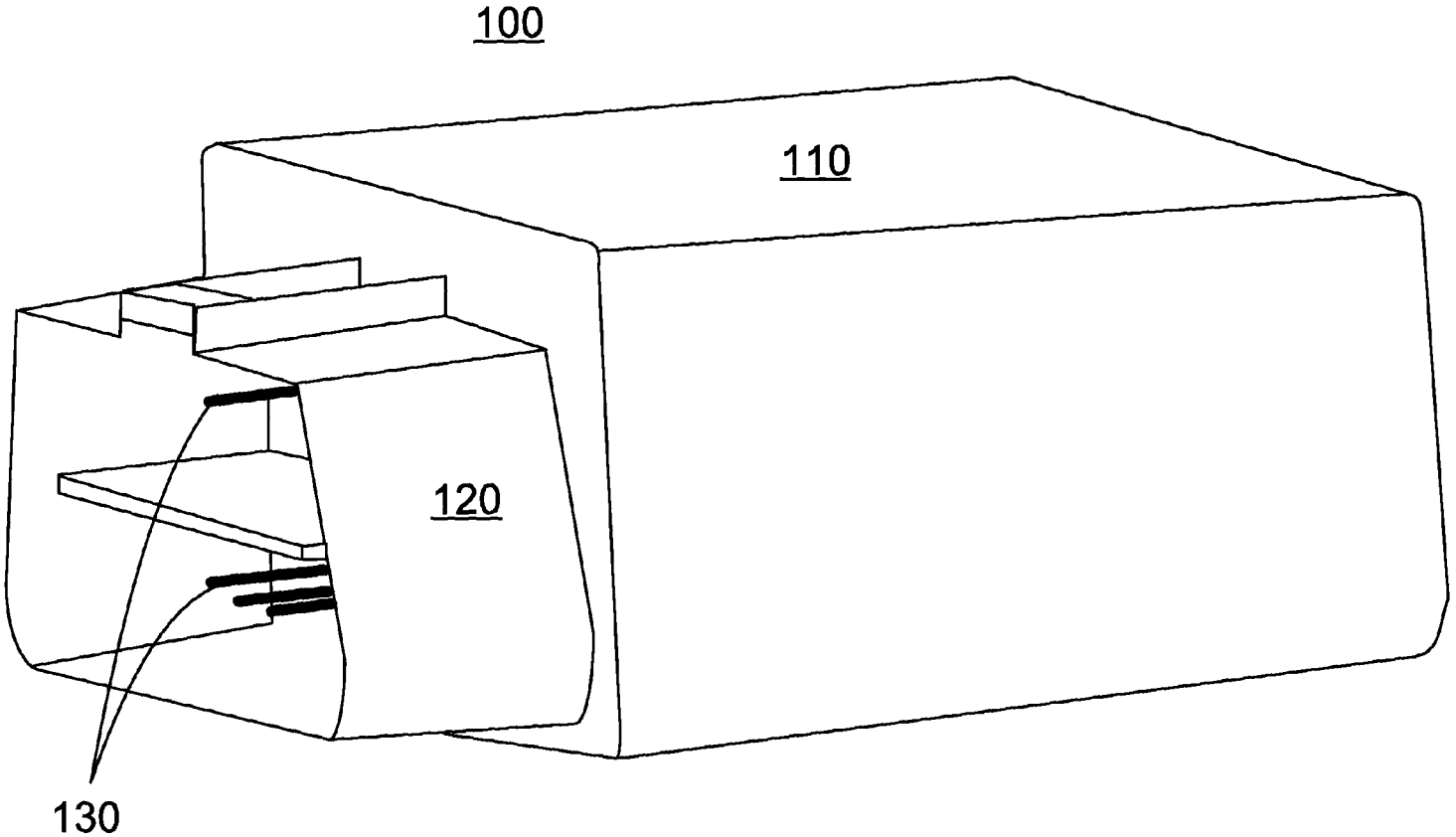
FIG. 1 illustrates an example conventional OBD device.

Example embodiments and their potential advantages are understood by referring to FIGS. 1-4 of the drawings.

Various embodiments of the present invention are directed to maximizing antenna efficiency in an OBD device having a radio modem, while maintaining a small/smallest form factor for the OBD device.

Radio frequency (RF) modems or "radio modems" are RF transceivers for data, which are capable of receiving and transmitting signals to and from other radio modems. A radio modem may be internally or externally mounted to another device, such as a host computing device (e.g., an OBD device, or other computing module or device) for communicating data to and from the host computing device to which the RF modem is mounted. As described above, OBD devices may utilize digital communications to relay OBD data obtained from a vehicle. Accordingly, OBD devices may utilize such radio modems to effectuate this digital communication.

Generally, radio modems that cooperatively operate with a host computing device (e.g., an OBD device) may include: (1) a radio portion, also called an RF front end or an RF head; (2) a modulator/demodulator portion, also called a baseband processing unit or baseband chip; (3) a central processing unit (CPU) or processor; (4) a memory; and (5) an interface. Such radio modems generally operate using software code to communicate between the host computing device and a base station. The above-described radio modem components/modules collectively operate during a wireless communications process to receive electromagnetic RF signals in a receive mode. Such RF signals contain information to be extracted from the received RF signal. In a transmit mode, radio modem components work collectively to transmit electromagnetic RF signals, the RF signals containing the information to be transmitted. Moreover, during receive and transmit modes, the radio modem components collectively operate to perform three principal modem functions: RF conversion, baseband processing and protocol stack control.

Typically, during RF conversion, a radio modem receives RF signals during the receive mode and converts the RF signals into modulated baseband analog signals. During transmit mode, the RF head converts modulated baseband analog signals into RF signals for transmission. During baseband processing, the baseband processing unit in the receive mode demodulates modulated baseband analog signals by extracting a plurality of data bits that correspond to the information being received. In the transmit mode, the baseband processing unit generates modulated baseband analog signals for processing by the radio modem.

As part of the wireless communications process described above, data bits being transmitted are wrapped with protocol bits of data to facilitate transmission, routing, and receiving of the data bits. Likewise, such protocol data is removed to accurately reproduce, in the receiving radio modem, the data that was sent. The adding or stripping of the protocol bits, also called protocol stack control, is generally performed by the processor in the radio modem under the control of a protocol stack software program stored in the radio modem's memory. Finally, the interface feeds the data bits from the host computing device to the radio modem for processing and transmission, and feeds to the host computing device the reproduced data bits that were extracted from the received RF signal.

Further, radio modems may be configured to operate within certain frequency bands that include, e.g., the 900 MHz, 2.4 GHz, 5 GHz, 23 GHz, Very High Frequency (VHF), and Ultra High Frequency (UHF) ranges. Operating modes for radio modems may include point-to-point, point-to-multipoint, and repeater modes. Point-to-point radio modems can transmit to only one modem/radio modem at a time. Point-to-multipoint modems can transmit to several modems/radio modems at a time.

Radio communication techniques include direct sequence spread spectrum and frequency hopping spread spectrum, where spread spectrum is used to reduce the impact of localized frequency interferences. To achieve this, a radio modem utilizes more bandwidth than is needed by the system. There are two main spread spectrum modalities: direct sequence and frequency hopping. In accordance with principles of direct sequence spread spectrum, a signal is spread over a larger band by multiplexing it with a code (signature) to minimize localized interference and noise, and accordingly, the radio modem works over a large band. To spread the signal, each bit is modulated by a code. Frequency hopping spread spectrum uses a technique where the signal walks through a set of narrow channels in sequence. The transmission frequency band is divided into a certain number of channels, and the radio modem periodically hops to a new channel, following a predetermined cyclic hopping pattern. The radio modem avoids interference by not staying in the same channel for a long period of time.

Radio communication techniques may also include orthogonal frequency division multiplexing (OFDM), a technique whereby a data message is split into fragments, and which employs a single transmitting source. The fragments are then simultaneously transmitted over a cluster of, e.g., adjacent, RF channels, where all the RF channels operate using the same modulation and coding type and are controlled by the same protocol rules.

Further still, common performance aspects of radio modems include full duplex transmission, maximum output power, number of channels, and sensitivity. Full duplex radio modems can transmit and receive at the same time. Maximum output power is the transmission power of the radio modem, and is defined as the strength of the signals emitted, often measured in mW. The number of channels defines the number of transmitting and receiving channels of the radio modem, while a radio modem's sensitivity may be measured by the weakest signal that may be reliably sensed by the receiver.

The operational principles and benefits of radio modems, as discussed above, may enhance the functionality of other devices that gather, compile and perform operations on data, e.g., OBD devices, thus enhancing their utility and convenience. As previously described, an OBD device can refer to an electronic apparatus that can be connected to an OBD port of a vehicle to read relevant data/information from one or more vehicle computer systems. That is, the OBD device can connect to an engine control unit (ECU), for example. The ECU may use a microprocessor to control various aspects of a vehicle's engine to ensure optimum operation. It may read information from various sensors, looking at, e.g., ignition timing, idle speed, controlling air/fuel ratios, etc. to glean relevant information and make adjustments to the vehicle's engine. Such information and data may be gathered and analyzed with the help of an OBD to diagnose faults or enhance engine performance. Still other OBD systems can connect to vehicle emission control systems and detect malfunctions that could cause the vehicle's emissions to run afoul of Environmental Protection Agency (EPA) thresholds.

An OBD device that includes an integrated radio modem, such as that described above, may utilize a communications network, such as a wireless wide area network (WWAN), for example, to communicate relevant data/information to some remote location, e.g., a diagnostic computer, without the need for a wired connection. Moreover, an OBD device is generally housed within, e.g., a plastic housing, particularly, if it includes a radio modem. This is because the plastic housing will be transparent to the radio signals, e.g., transmitted by the radio modem, thereby allowing the radio modem antenna to also be housed within the plastic housing.

The location of the OBD port in a vehicle may often be close to the steering column, which may not be an optimal location for radio modem operation. Moreover, it is preferable that the dimensions of an OBD device are as small as possible so that it is non-obtrusive to the driver of the vehicle.

However, conventional OBD devices that include an integrated radio modem are often very long or have poor radio modem antenna efficiency. That is, in conventional OBD devices that have poor radio modem antenna efficiency, it is often the case that to maintain a smaller footprint, the counterpoise of the radio modem antenna is short. In the case of conventional OBD devices that attempt to improve radio modem antenna efficiency, the length of the overall OBD device is often very long to accommodate a preferably longer counterpoise.

For example, FIG. 1 illustrates a conventional OBD device 100 that has a plastic housing 110. Within the plastic housing, are the various components/electronics necessary for providing the requisite OBD functionality, as well as the radio modem for providing connectivity and communications between the vehicle and the OBD device 100. The plastic housing 110 can further include an OBD connector 120 that is plastic (or is mated to a plastic connector). This OBD connector 120 may be the mechanical interface to the vehicle. The electrical interface to the vehicle can be effectuated through conductive pins 130 that feed from the various components/electronics within the plastic housing 110 through the OBD connector 120.

Figure 2:
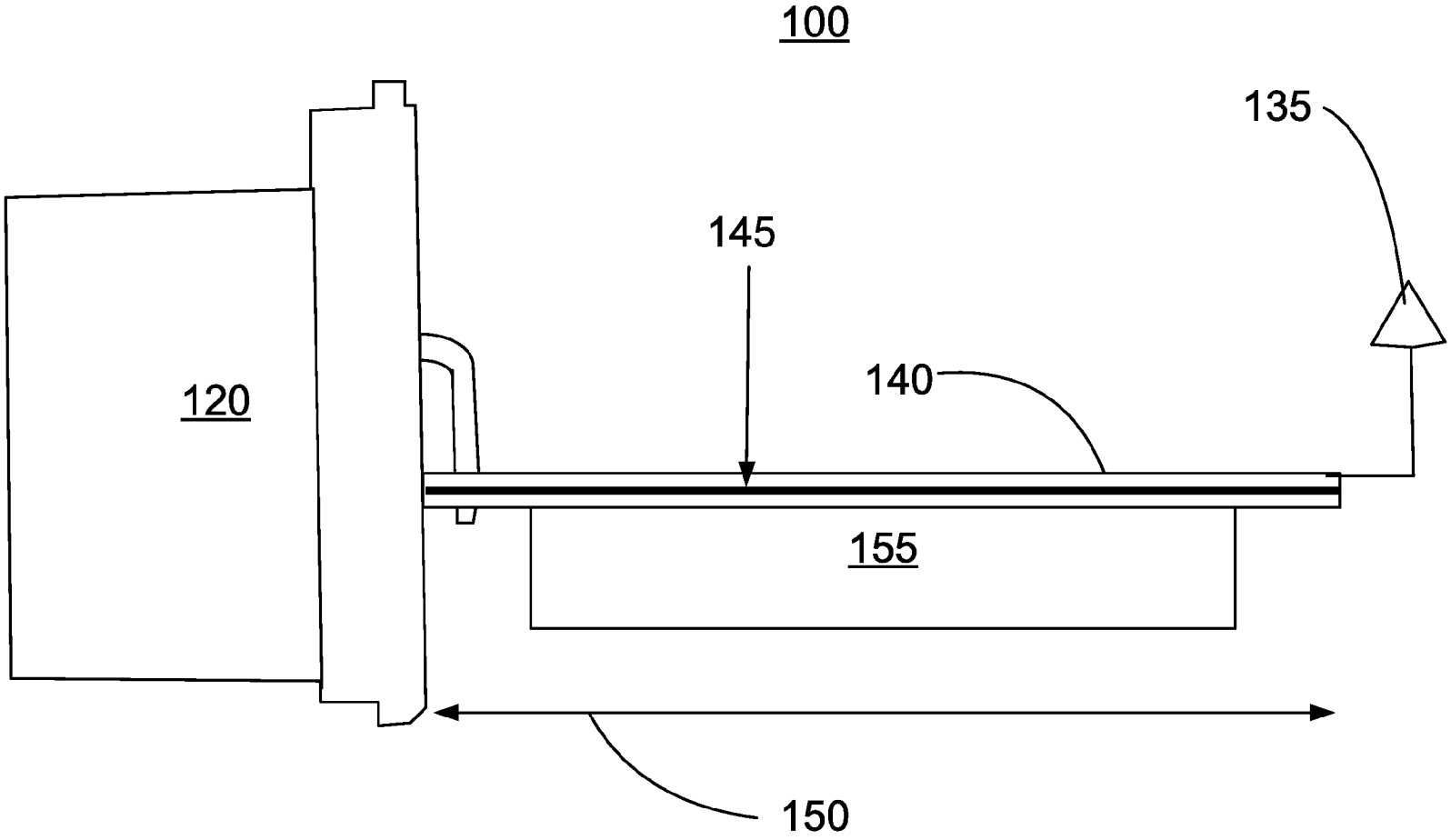
FIG. 2 illustrates a cross-sectional view of the example conventional OBD device of FIG. 1.

FIG. 2 illustrates a cross-sectional view of the OBD device 100 of FIG. 1. The OBD device 100 can include an antenna 135 (operatively connected to a radio modem 155)

that is mounted onto a printed circuit board (PCB) 140. The PCB 140 can have a ground plane 145. As alluded to above, the counterpoise of a radio modem antenna in conventional OBD devices may often be limited by the dimensions of the OBD device, and in particular, the PCB of the OBD device, in this example, PCB 140 of OBD device 100. That is, an antenna counterpoise is some structure of conductive material that can improve or substitute for the ground, which in certain devices may be the ground plane of a PCB. Accordingly, in FIG. 2, the counterpoise 150 of antenna 135 is the ground plane 145.

Figure 3:
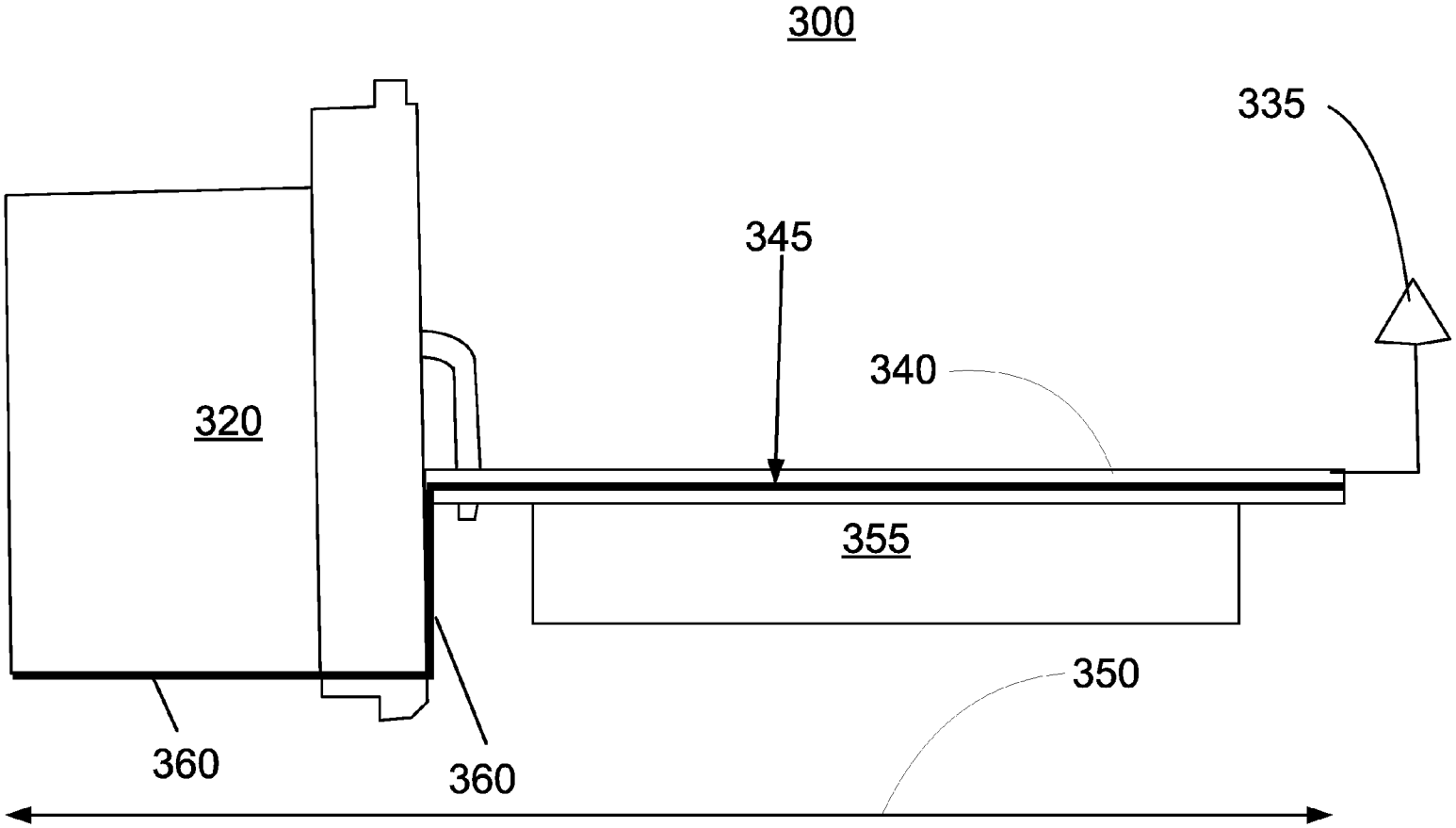
FIG. 3 illustrates an example OBD device having a conductive extension in accordance with one embodiment of the present disclosure.

FIG. 3 illustrates an example OBD device 300 configured in accordance with one embodiment that has improved antenna efficiency by using a longer antenna counterpoise without increasing the overall length, size, and/or footprint of the OBD device 300. Like the OBD device 100 of FIGS. 1 and 2, the OBD device 300 of FIG. 3 can include an antenna 335 (operatively connected to a radio modem 355) that is mounted onto a PCB 340.

However, and in accordance with one embodiment, the PCB 340 can have a ground plane 345 to which a conductive element/extension 360 (added to an OBD connector 320, for example) is connected. Accordingly, the ground plane 345 of the PCB 340 is effectively lengthened/extended, e.g., away from the antenna 335, and therefore, the counterpoise 350 of the antenna 335 is increased.

Figure 4:
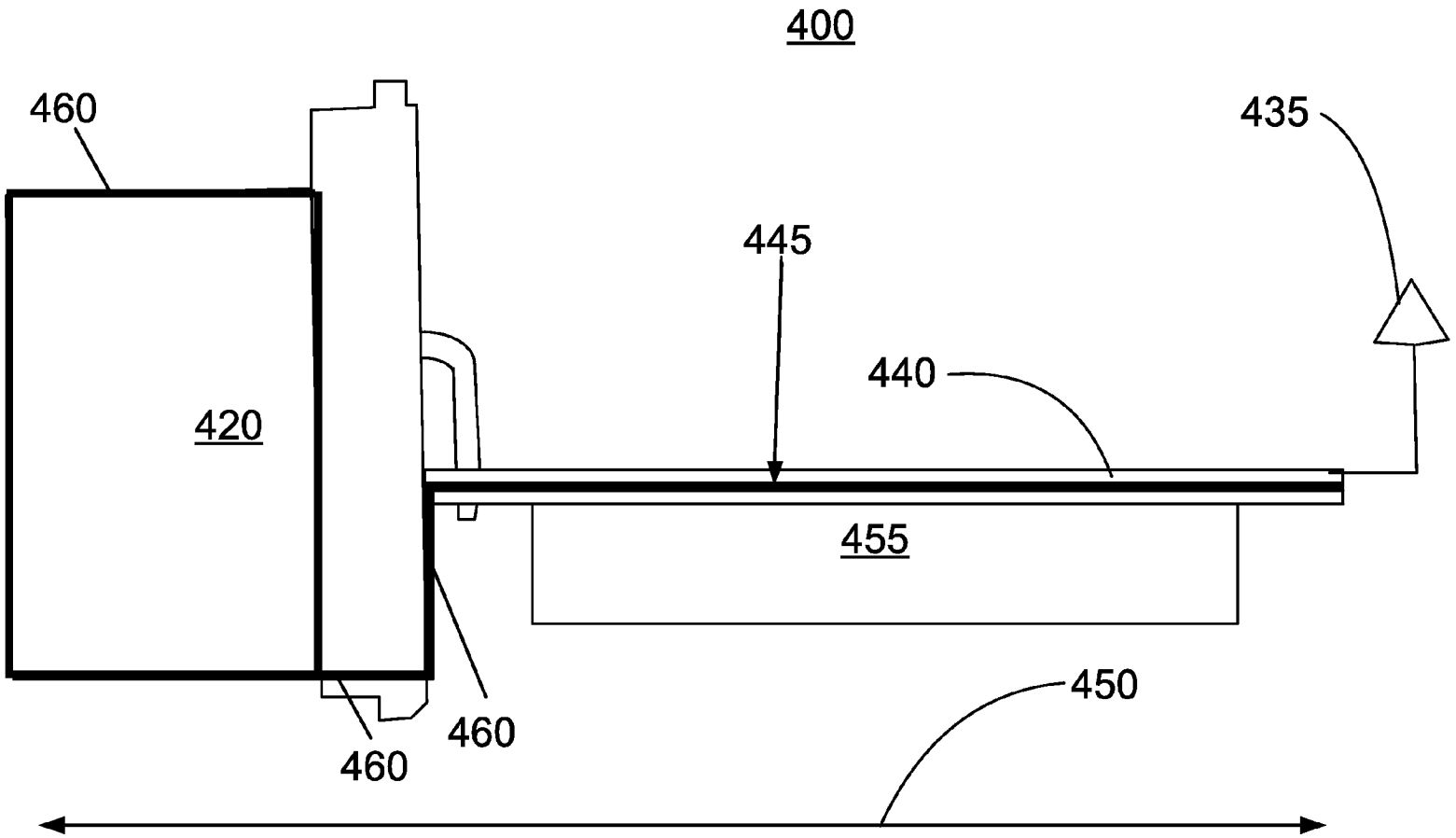
FIG. 4 illustrates another example OBD device having a conductive extension in accordance with another embodiment of the present disclosure.

FIG. 4 illustrates another example OBD device 400 configured in accordance with another embodiment that also has improved antenna efficiency by using a longer antenna counterpoise without increasing the overall length, size, and/or footprint of the OBD device 400. Again, and like the OBD device 100 of FIGS. 1 and 2, the OBD device 400 of FIG. 4 can include an antenna 435 (operatively connected to a radio modem 455) that is mounted onto a PCB 440. However, and in accordance with another embodiment, the PCB 440 can have a ground plane 445 to which a conductive element/extension 460 is connected. In this example, the conductive element 460 may be implemented by fabricating all or at least part of an OBD connector 420 from a metallic material. Alternatively, all or at least part of the OBD connector 420 can be encased in a metallic material or insert molded with metal. Accordingly, the ground plane 445 of the PCB 440 is again, effectively lengthened/extended, e.g., away from the antenna 435, and therefore, the counterpoise 450 of the antenna 435 is increased.

It should be noted that the conductive element/extension illustrated in FIGS. 3 and 4 can be fabricated from one or more conductive materials, and can be electrically and mechanically connected to the ground plane of a PCB. The conductive element/extension utilized in accordance with various embodiments, as described above, allows for greater efficiency and/or bandwidth in the antenna design. It should further be noted that other configurations of the conductive element/extension are contemplated in accordance with other embodiments to extend the effective length of the counterpoise. For example, the conductive element/extension can be "routed" in various directions in/about the PCB and/or OBD device to increase performance of an antenna.

Various embodiments of the present invention may be implemented in a system having multiple communication devices that can communicate through one or more networks. The system may comprise any combination of wired or wireless networks such as a mobile telephone network, a wireless Local Area Network (LAN), a Bluetooth personal area network, an Ethernet LAN, a wide area network, the Internet, etc.

The communication devices may communicate using various transmission technologies such as OFDM, Code Division Multiple Access (CDMA), Global System for Mobile Communications (GSM), Universal Mobile Telecommunications System (UMTS), Time Division Multiple Access (TDMA), Frequency Division Multiple Access (FDMA), Transmission Control Protocol/Internet Protocol (TCP/IP), Short Messaging Service (SMS), Multimedia Messaging Service (MMS), e-mail, Instant Messaging Service (IMS), Bluetooth, IEEE 802.11, etc.

Various embodiments described herein are described in the general context of method steps or processes, which may be implemented in one embodiment by a software program product or component, embodied in a machine-readable medium, including executable instructions, such as program code, executed by entities in networked environments. Generally, program modules may include routines, programs, objects, components, data structures, etc. that perform particular tasks or implement particular abstract data types. Executable instructions, associated data structures, and program modules represent examples of program code for executing steps of the methods disclosed herein. The particular sequence of such executable instructions or associated data structures represents examples of corresponding acts for implementing the functions described in such steps or processes.

Software implementations of various embodiments of the present invention can be accomplished with standard programming techniques with rule-based logic and other logic to accomplish various database searching steps or processes, correlation steps or processes, comparison steps or processes and decision steps or processes.

The foregoing description of various embodiments have been presented for purposes of illustration and description. The foregoing description is not intended to be exhaustive or to limit embodiments of the present invention to the precise form disclosed, and modifications and variations are possible in light of the above teachings or may be acquired from practice of various embodiments of the present invention. The embodiments discussed herein were chosen and described in order to explain the principles and the nature of various embodiments of the present invention and its practical application to enable one skilled in the art to utilize the present invention in various embodiments and with various modifications as are suited to the particular use contemplated. The features of the embodiments described herein may be combined in all possible combinations of methods, apparatus, modules, systems, and computer program products.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. An apparatus configured to be plugged into an on board diagnostic (OBD) port in a vehicle, the apparatus also being configured to monitor and/or collect and wirelessly transmit vehicle data, the apparatus comprising:

a printed circuit board having a ground plane;

a wireless transceiver comprising an antenna element operatively connected to the printed circuit board such that the ground plane defines a counterpoise for the antenna element, the counterpoise having an effective length;

an extension element, coupled to the ground plane in at least one of an electrical or mechanical manner, for extending the effective length of the counterpoise; and an OBD connector configured to electrically and/or mechanically connect the apparatus to the OBD port, wherein the extension element is primarily located in the OBD connector.

2. The apparatus of claim 1 further comprising, a connector, wherein the extension element comprises at least a portion of the OBD connector.

3. The apparatus of claim 2, wherein the extension element comprises a metallic trace extending away from the antenna element, through the OBD connector.

4. The apparatus of claim 1, wherein the extension element comprises a conductive material.

5. The apparatus of claim 1 further comprising a housing, at least a portion of the housing comprising a material transparent to radio signals.

6. The apparatus of claim 5, wherein the material transparent to radio signals is a plastic material.

7. The apparatus of claim 1, wherein the wireless transceiver is configured to receive and transmit data to and from a remote location via one or more networks.

8. An on-board diagnostic (OBD) device configured to be plugged into an OBD port in a vehicle, the OBD device also being configured to monitor and/or collect and wirelessly transmit vehicle data, comprising:

an integrated radio modem communicatively coupled with a printed circuit board, the printed circuit board comprising a ground plane;

an antenna mounted to the printed circuit board, wherein the ground plane defines a counterpoise for the antenna, the counterpoise having an effective length; and an OBD connector for connecting the OBD device to the OBD port in the vehicle, the OBD connector comprising a conductive extension, the conductive extension being conductively coupled to the ground plane to extend the effective length of the counterpoise in a direction away from the antenna.

9. The OBD device of claim 8, wherein at least one area of the OBD connector is either encased in or fabricated of a metallic material.

10. The OBD device of claim 9, wherein the conductive extension comprises at least a portion of the area of the OBD connector encased in or fabricated of the metallic material.

11. The OBD device of claim 8, wherein the conductive extension comprises an insert molded with metal.

12. The OBD device of claim 8 further comprising, a housing, wherein at least a portion of the housing comprises a material transparent to radio signals.

13. The OBD device of claim 12, wherein the antenna is located within the housing.

14. An on board diagnostic (OBD) device configured to be plugged into an OBD port in a vehicle, the OBD device also being configured to monitor and/or collect and wirelessly transmit vehicle data, comprising:

a printed circuit board having a ground plane, the printed circuit board being located within a housing, and the housing comprising an integrated connector; and a radio modem and an antenna operatively connected to the radio modem, the antenna being mounted to the printed circuit board such that the ground plane provides a counterpoise for the antenna, the counterpoise having an effective length, wherein the integrated connector is configured for electrically and/or mechanically connecting the OBD device to the OBD port in the vehicle and wherein the integrated connector comprises a conductive element connected to the ground plane in at least one of a mechanical or electrical fashion, the conductive element being configured to extend the effective length of the counterpoise away from the antenna, such that the extended effective length of the counterpoise is greater than a length of the ground plane.

15. The OBD device of claim 14, wherein at least one area of the integrated connector is fabricated from a metallic material, and wherein the conductive element comprises the at least one area of the integrated connector fabricated from the metallic material.

16. The OBD device of claim 14, wherein the conductive element is fabricated from a metal.

17. The OBD device of claim 16, wherein the conductive element comprises one or more inserts molded with metal.

18. The OBD device of claim 14, wherein at least one area of the integrated connector is encased in a metallic material such that the conductive element comprises the at least one area of the integrated connector encased in the metallic material.

19. The OBD device of claim 14, wherein the antenna is located within the housing, and at least a portion of the housing is transparent to radio signals.

20. The OBD device of claim 19, wherein the portion of the housing transparent to radio signals is constructed of a plastic material.

* * * * *